US005443655A

United States Patent [19]

Stover et al.

[11] Patent Number: 5,443,655

[45] Date of Patent: Aug. 22, 1995

[54] METHOD FOR ADJUSTING THE RINSE CYCLE OF A WAREWASHER

[75] Inventors: Kevin L. Stover, Pleasant Hill; Richard W. Cartwright, Piqua; Thomas A. Grueser, Donnelsville; Walter J. Boryca, Troy, all of Ohio

[73] Assignee: Premark FEG Corporation, Wilmington, Del.

[21] Appl. No.: 226,885

[22] Filed: Apr. 13, 1994

[51] Int. Cl.[6] ..... B08B 3/04

[52] U.S. Cl. ..... 134/18; 134/25.2; 134/25.4

[58] Field of Search ..... 134/18, 25.2, 25.4

[56] References Cited

U.S. PATENT DOCUMENTS 4,810,306 3/1989 Noren ..... 134/25.2

5,284,523 2/1994 Badami et al. ..... 134/18

*Primary Examiner*—John Sheehan

*Attorney, Agent, or Firm*—Thompson, Hine & Flory

[57] ABSTRACT

A method for rinsing ware in a warewashing machine comprising the steps of: adding fresh rinse water to a wash chamber of the warewashing machine to rinse said ware in a rinse cycle; detecting the water level in the wash chamber; upon detecting a level below a predetermined volume, continuing to add rinse water to said chamber; and upon detecting a level of water equal to said predetermined volume, discontinuing the step of adding rinse water to said chamber.

18 Claims, 1 Drawing Sheet

WASH FIG. 2b

METHOD FOR ADJUSTING THE RINSE CYCLE OF A WAREWASHER

BACKGROUND OF THE INVENTION

The invention relates to a warewasher in which the volume of water in the rinse cycle can be controlled so as to provide proper machine operation under conditions of low water pressure.

More particularly, the invention relates to a fresh water rinse machine. This warewasher has a relatively large reservoir located beneath the ware rack which holds about 3 gallons of water. In a typical cycle, the reservoir is filled with water and a proportionate amount of detergent is added for washing. The water in this reservoir is used and reused by pumped recirculation of the wash water for washing successive racks of ware. Fresh water is added after each wash cycle by means of a fresh water spray system which rinses the rack of ware at the proper time in the cycle, after the rack has been washed. Fresh water rinsing is performed while the recirculation pump is off. About 1.2 gallons of fresh water is added to the wash water in each cycle to rinse the current rack of dishes. Because fresh water is added to the tank during the rinse, the system does a partial pumped drain between the wash and rinse cycles. One advantage of this system is that wash water is reused for subsequent cycles. The tank is completely drained only when the water in the tank is fairly soiled.

Conventionally, during the rinse cycle, the control system opens the "fill" valve for a predetermined time. This is commonly referred to as a timed rinse. With nominal water pressure of 20 psi, this rinse adds the required amount of water to the wash chamber. After the end of the timed rinse, the cycle continues for a dwell period.

While it is conventional to use timed rinses to control the volume of water used in the rinse cycle, a number of problems arise during operation of a warewasher in areas having low water pressure or in places where extensive use of water simultaneously will result in such a water demand that water pressure is reduced. A typical water pressure is about 20 psi. Most warewashers should be able to accommodate modest changes of $\pm 5$ psi in water pressure without affecting the quality of its operation. A low pressure environment therefore, is defined as a situation with less than about 15 psi of water pressure. In such a low pressure environment, the warewasher may not receive a sufficient amount of rinse water. This can deteriorate rinse performance. Less water pressure in the system produces a reduction in water flow, which results in less water added to the machine to rinse the ware. Wash performance also suffers in low water pressure sites using a timed rinse. Proportionately less water is added back to the tank for a subsequent wash cycle. This can result in unacceptable fill levels which offset pump pressure. At low pump pressures, there may be not enough pump pressure to clean some soil off the ware.

One method has been known in the art to adjust for low water pressure. This method employs an adjustable cam timer to control the time of the warewasher's rinse cycle. In a low pressure situation, the cam is manually adjusted to increase the length of time the fill valve is open during the rinse cycle. However, there is no guarantee that the adjusted time will produce the required amount of rinse water.

Therefore, it is an object of the present invention to provide a method for controlling the rinse cycle in a fresh water rinse machine by detecting the volume of water used in the rinse so that in low water pressure areas, the required amount of rinse water will be provided for proper machine operation.

SUMMARY

In accordance with the present invention, a method for rinsing ware in a low pressure environment so as to provide the required volume of rinse water is provided comprising the steps of adding fresh rinse water to a wash chamber of the warewashing machine to rinse said ware in a rinse cycle; detecting a water level in the wash chamber; upon detecting a water level below a predetermined volume, continuing to add rinse water to the chamber; and upon detecting a level of water equal to the predetermined volume, discontinuing the step of adding the rinse water to the chamber.

By changing from a purely timed rinse to a volumetric control of the rinse cycle, both wash and rinse performance can be improved.

BRIEF DESCRIPTION OF THE DRAWING

The invention will now be described by way of example and with reference to the accompanying drawings, in which.

DESCRIPTION OF THE PREFERRED EMBODIMENT

In a typical embodiment of the invention, the warewasher employs three water level sensors placed at different depths within the wash chamber. A typical warewasher holds about 3 gallons of water. The sump holds about 2.6 gallons and the remainder of the water is in the pump and wash system. One sensor, the wash level sensor, is placed at an optimum level for the initial fill of water. This is about the three gallon mark for this specific example and is the amount of water used in the wash cycle. A middle level sensor is placed at a level about 1.2 gallons below the top sensor. A low level sensor which is an optional but desirable feature, is placed even lower in the tank. If water is detected below this low sensor, the heater shuts off and if water is not recovered, the system shuts down. A pumped drain is used to remove the water from the tank.

The wash cycle begins with the water volume at the wash level sensor. After the wash cycle, water is drained from the wash level to the middle sensor before the rinse begins. The rinse should then optimally add fresh water from the middle level sensor to the wash level sensor to refill the machine.

In accordance with the preferred embodiment of the invention, the warewasher is programmed for a predetermined rinse time and a predetermined dwell time. Typically, these are 10 seconds for the rinse and 6 seconds for the dwell. These preset times typically cannot be changed by the user.

In a fresh water rinse machine, assuming a standard water pressure, during the predetermined rinse time, water will be filled by water emanating from the rinse arms from the middle level back to the wash level sensor. This amount of rinse water is typically about 1.2 gallons of water, or such other amount as required to clean the ware. The rinse water may include chlorine, another sanitizing agent, or hot water. In accordance with the preferred embodiment of the invention, the rinse cycle proceeds for the predetermined time after which the amount of water in the tank is detected. If during the programmed time enough rinse water has not been added to reach the wash level sensor (i.e., in areas of low water pressure), then additional rinse water will be added until the top level sensor is reached, whereupon the flow of rinse water is stopped. This ensures that the proper volume of rinse water for proper machine operation is used to rinse the ware. For example, if the sensors are placed 1.2 gallons apart, the flow of rinse water will not stop until 1.2 gallons of rinse water are present in the machine. Those skilled in the art will appreciate that the rinse cycle can be controlled independently of time, i.e., without a preprogrammed rinse cycle time.

Figure 1:
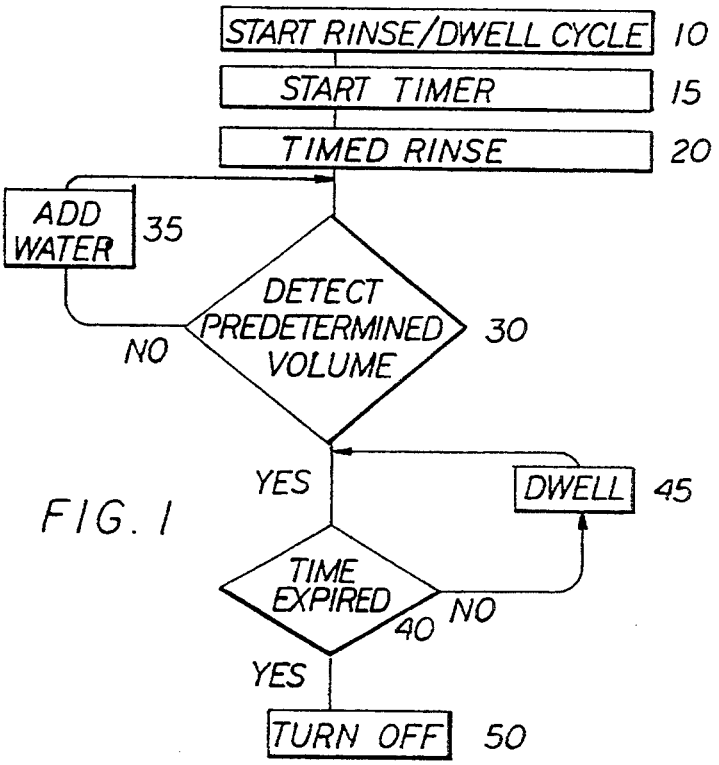
FIG. 1 is a flow chart which illustrates a process of the present invention.

The method of the invention will now be described with reference to the flow chart of FIG. 1. The addition of rinse water 10 begins in a timed cycle 15 and proceeds for a scheduled time 20. This is typically 10 seconds. The wash level sensor may be monitored continuously or periodically 30. If the water level reaches the wash level sensor within the rinse cycle time, then the predetermined volume of rinse water is present and the rinse water is shut off. If the requisite amount of water is not detected, the addition of rinse water is continued at 35 until the wash level sensor detects the predetermined volume (e.g. 1.2 gallons).

Figure 2A:
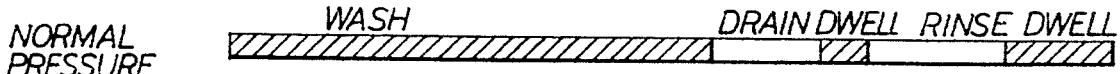
FIGS. 2(*a*)–2(*c*) are cycle timing charts of the present invention.
Figure 2C:
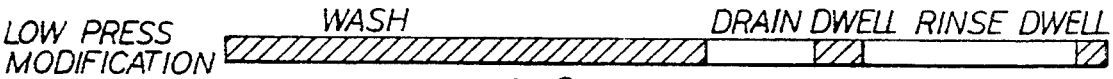
Figure 2C:
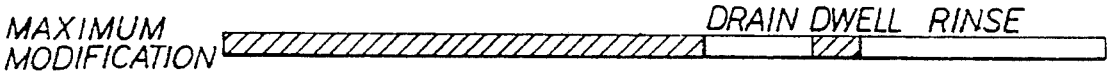

It is generally undesirable to change the total time of the rinse and dwell cycles. As a result, if additional time is used for the rinse cycle, it is subtracted from the programmed time that normally would have been used for the final dwell. Therefore, in accordance with a preferred embodiment, a determination is made whether the preset time for the rinse/dwell cycle has elapsed. This occurs at 40. If the time normally used for the dwell has been used to add additional volume of rinse water, then the fill valve turns off 50 and the cycle is complete. The fill valve is shut off ending the rinse cycle if the preset time is exceeded, even if the proper amount of water is not present. If time remains in the rinse/dwell cycle, (i.e. if the addition of rinse water didn't take the maximum time) the remainder of the preset time is used for the final dwell 45. For example, if the normal programmed rinse cycle is 10 seconds and the normal final dwell is 6 seconds, the minimum rinse time is the programmed 10 seconds. This would occur as in FIG. 2(*a*) when there is an acceptable water pressure (e.g., 20 psi). The maximum rinse time is 16 seconds for very low water pressures (e.g., 12 psi). This includes the normal 10 second rinse plus the maximum 6 additional seconds from the modification as in FIG. 2(*c*). If rinse water is added for less than the maximum additional time, 6 seconds in this example, then the remainder of the time will be used for the final dwell as in FIG. 2(*b*). Note that the total cycle length remains the same. The extra rinse time is allocated from the final dwell. Therefore, in this example, the total rinse time can be anywhere from a minimum of 10 to a maximum of 16 seconds.

In accordance with the invention, the sump always has enough water to provide good pump pressures. In addition, a full tank of water will be present for the next wash cycle. Thus, both wash and rinse performance is assured.

Having described the invention in detail and by reference to preferred embodiments thereof, it will be apparent that modifications and variations are possible without departing from the scope of the invention defined in the appended claims.

What is claimed is:

1. A method for rinsing washed ware in a warewashing machine comprising the steps of:

adding fresh rinse water to a wash chamber of the warewashing machine to rinse said ware in a rinse cycle;

detecting the water level in the wash chamber;

upon detecting a level below a selected volume, continuing to add rinse water to said chamber; and upon detecting a level of water equal to said selected volume, discontinuing the step of adding rinse water to said chamber.

2. The method of claim 1 including the additional step of timing the rinse cycle wherein the step of detecting the water level occurs after a first time.

3. The method of claim 2 further comprising:

after discontinuing the step of adding rinse water, checking the time of the rinse cycle; and if said time is less than a second time at which said rinse cycle is terminated, maintaining said ware in said wash chamber for the duration of said second predetermined time.

4. The method of claim, 1 wherein the wash chamber includes a first water level sensor and a second water level sensor and wherein the selected volume of said rinse water is determined by the placement of the first sensor with respect to the second sensor.

5. The method of claim 2 wherein said first time is 10 seconds.

6. The method of claim 3 wherein said second time is 16 seconds.

7. The method of claim 4 wherein said selected volume of rinse water is sufficient to meet performance requirements.

8. The method of claim 7 wherein said selected volume is approximately 1.2 gallons of water.

9. The method of claim 3 wherein said step of maintaining said ware in said wash chamber includes heating said ware.

10. A method for ware washing comprising the steps of:

washing said ware with wash water in a wash chamber;

draining a portion of said wash water from said wash chamber;

adding fresh rinse water to the wash water to rinse said ware in a rinse cycle;

detecting the water level in said wash chamber;

upon detecting a level of water below a selected volume, continuing to add rinse water to said chamber; and upon detecting a level of water equal to said selected volume, discontinuing the step of adding rinse water to said chamber.

11. The method of claim 10 including the additional step of timing the rinse cycle wherein the step of detecting the water level occurs after a first time.

12. The method of claim 11 including the additional steps of:

after discontinuing the step of adding rinse water, checking the time of the rinse cycle; and if said time at which said rinse cycle is terminated is less than a second time, maintaining said ware in said wash chamber for the duration of said second time.

13. The method of claim 10 wherein the wash chamber includes a first water level sensor and a second water level sensor and wherein said selected volume of said rinse water is determined by the placement of the first sensor with respect to the second sensor.

14. The method of claim 13 wherein said selected volume of rinse water is sufficient to meet performance requirements.

15. The method of claim 11 wherein said first time 10 seconds.

16. The method of claim 12 wherein said second time is 16 seconds.

17. The method of claim 14 wherein said selected volume is approximately 1.2 gallons of water.

18. The method of claim 12 wherein maintaining said ware in said wash chamber includes heating said ware.

* * * * *